US007389659B1

(12) United States Patent
Diaz et al.

(10) Patent No.: US 7,389,659 B1
(45) Date of Patent: Jun. 24, 2008

(54) SHACKLE APPARATUS

(76) Inventors: Carroll Diaz, 464 W. 47th St., Cut Off, LA (US) 70345; Derrick Prentice, 1300 Bayou Black Dr., Houma, LA (US) 70360

( * ) Notice: Subject to any disclaimer, the term of this patent is extended or adjusted under 35 U.S.C. 154(b) by 0 days.

(21) Appl. No.: 11/612,544

(22) Filed: Dec. 19, 2006

Related U.S. Application Data

(60) Provisional application No. 60/821,907, filed on Aug. 9, 2006, provisional application No. 60/753,122, filed on Dec. 22, 2005.

(51) Int. Cl.
*E05B 67/22* (2006.01)

(52) U.S. Cl. ..... 70/38 A; 70/38 R; 70/52

(58) Field of Classification Search ..... 70/38 R, 70/38 A, 35, 52, 53, 233
See application file for complete search history.

(56) References Cited

U.S. PATENT DOCUMENTS 2,259,271 A * 10/1941 Seay, Jr. ..... 70/38 A
2,374,669 A * 5/1945 DeQuick ..... 70/38 A
3,604,227 A * 9/1971 Athanason ..... 70/38 A
4,290,280 A * 9/1981 Yun ..... 70/38 A
4,881,387 A * 11/1989 Kortenbrede ..... 70/39
5,394,712 A * 3/1995 Chou ..... 70/38 A
5,398,529 A * 3/1995 Goldman et al. ..... 70/38 A
5,417,092 A * 5/1995 Iu ..... 70/38 A
5,640,861 A * 6/1997 Chen ..... 70/38 A
5,823,021 A * 10/1998 Chang ..... 70/38 A
6,430,975 B1 * 8/2002 McDaid ..... 70/39
6,584,815 B2 * 7/2003 Bremicker ..... 70/38 A
6,694,781 B1 * 2/2004 Li ..... 70/14
7,017,378 B2 * 3/2006 Hsieh ..... 70/49

* cited by examiner

*Primary Examiner*—Suzanne Dino Barrett
(74) *Attorney, Agent, or Firm*—Garvey, Smith, Nehrbass & North, L.L.C.; Charles C. Garvey, Jr.; Seth M. Nehrbass

(57) ABSTRACT

An improved shackle assembly is disclosed that provides a bow having specially configured end portions that interlock with a specially configured pin assembly. The pin assembly has locking members or lugs that move between locking and releasing positions. The locking lugs can be moved to a locking position or unlocked using a tool such as an allen wrench, screwdriver, or any other tool that rotates a drive shaft which is used to operate the locking lugs.

22 Claims, 17 Drawing Sheets

SHACKLE APPARATUS

CROSS-REFERENCE TO RELATED APPLICATIONS

Priority of U.S. Provisional Patent Application Ser. No. 60/753,122, filed Dec. 22, 2005, incorporated herein by reference, is hereby claimed.

Priority of U.S. Provisional Patent Application Ser. No. 60/821,907, filed Aug. 9, 2006, incorporated herein by reference, is hereby claimed.

STATEMENT REGARDING FEDERALLY SPONSORED RESEARCH OR DEVELOPMENT

Not applicable

REFERENCE TO A "MICROFICHE APPENDIX"

Not applicable

BACKGROUND OF THE INVENTION

1. Field of the Invention

The present invention relates to rigging for lifting of loads. More particularly, the present invention relates to an improved shackle apparatus that can be rigged to slings, lifting lines, or other rigging and wherein an interlocking arrangement is provided between the shackle bow portion and a pin assembly wherein connection of the pin assembly and bow is perfected by rotating a key or tool or lever operated drive shaft that engages a pair of locking lugs with indentations at end portions of the bow.

2. General Background of the Invention

Shackles have been used for many years as part of rigging for lifting items that are very heavy. Shackles are typically coupled to a lifting line of a lifting device such as a crane. Shackles can also be used to attach lifting lines to slings, to spreader bars, or to other devices that are used commonly in the rigging process.

One of the problems with shackles is that the pin which is attached to the bow using a threaded connection is easily disassembled, sometimes inadvertently.

BRIEF SUMMARY OF THE INVENTION

The present invention provides an improved shackle apparatus that has a bow with bow end portions, each having a recess. A pin assembly detachably connects to the bow, the pin assembly including a frame having spaced apart plates that carry locking members therebetween, each locking member being pivotally attached to the frame in between the plates, each locking member having a projecting end portion that engages a recess of a bow end portion when the bow is to be locked to the pin assembly.

A pinion gear is provided that engages the locking members, the pinion gear being positioned generally in between the locking members and engaged with the locking members so that when the pinion gear is rotated it rotates the locking members to a locking position, or to an unlocking position depending upon the direction of rotation of the pinion gear.

Pins are provided that extend through and are attached to the plates for holding the plates apart, each pin carrying a locking member. The drive shaft and pins are generally parallel in the preferred embodiment.

In the preferred embodiment, the locking members rotate upon the pins. In the preferred embodiment, the pinion gear rotates with the drive shaft, the drive shaft being rotatably attached to the two plates. Thus, the drive shaft and pinion gear are connected together and rotate together.

BRIEF DESCRIPTION OF THE SEVERAL VIEWS OF THE DRAWINGS

For a further understanding of the nature, objects, and advantages of the present invention, reference should be had to the following detailed description, read in conjunction with the following drawings, wherein like reference numerals denote like elements and wherein.

DETAILED DESCRIPTION OF THE INVENTION

Figure 1:
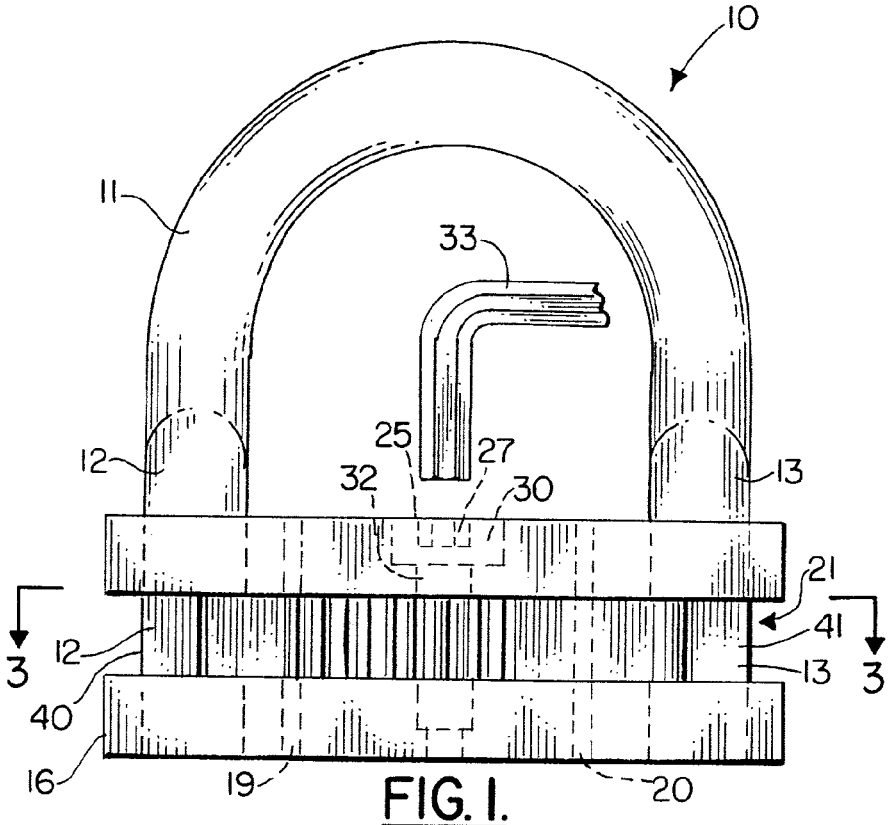
FIG. 1 is an elevation view of the preferred embodiment of the apparatus of the present invention.
Figure 2:
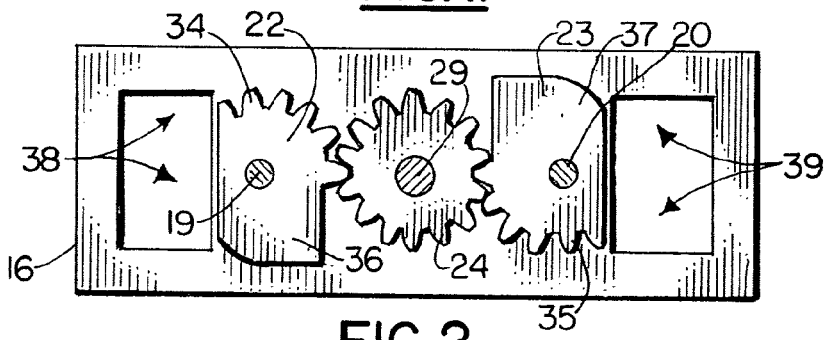
FIG. 2 is a partial plan view of the preferred embodiment of the apparatus of the present invention illustrating the locking members and pinion gear.

FIGS. 1-9 show the preferred embodiment of the apparatus of the present invention designated generally by the numeral 10. Shackle apparatus 10 provides a bow 11 having bow end portions 12, 13. Each of the bow end portions 12, 13 is slotted, the end portion 12 providing slot 14. The end portion 13 has a slot 15. Next to the slots 14, 15 the bow ends 12, 13 thus provide narrowed parts 40, 41 respectively.

Figure 4:
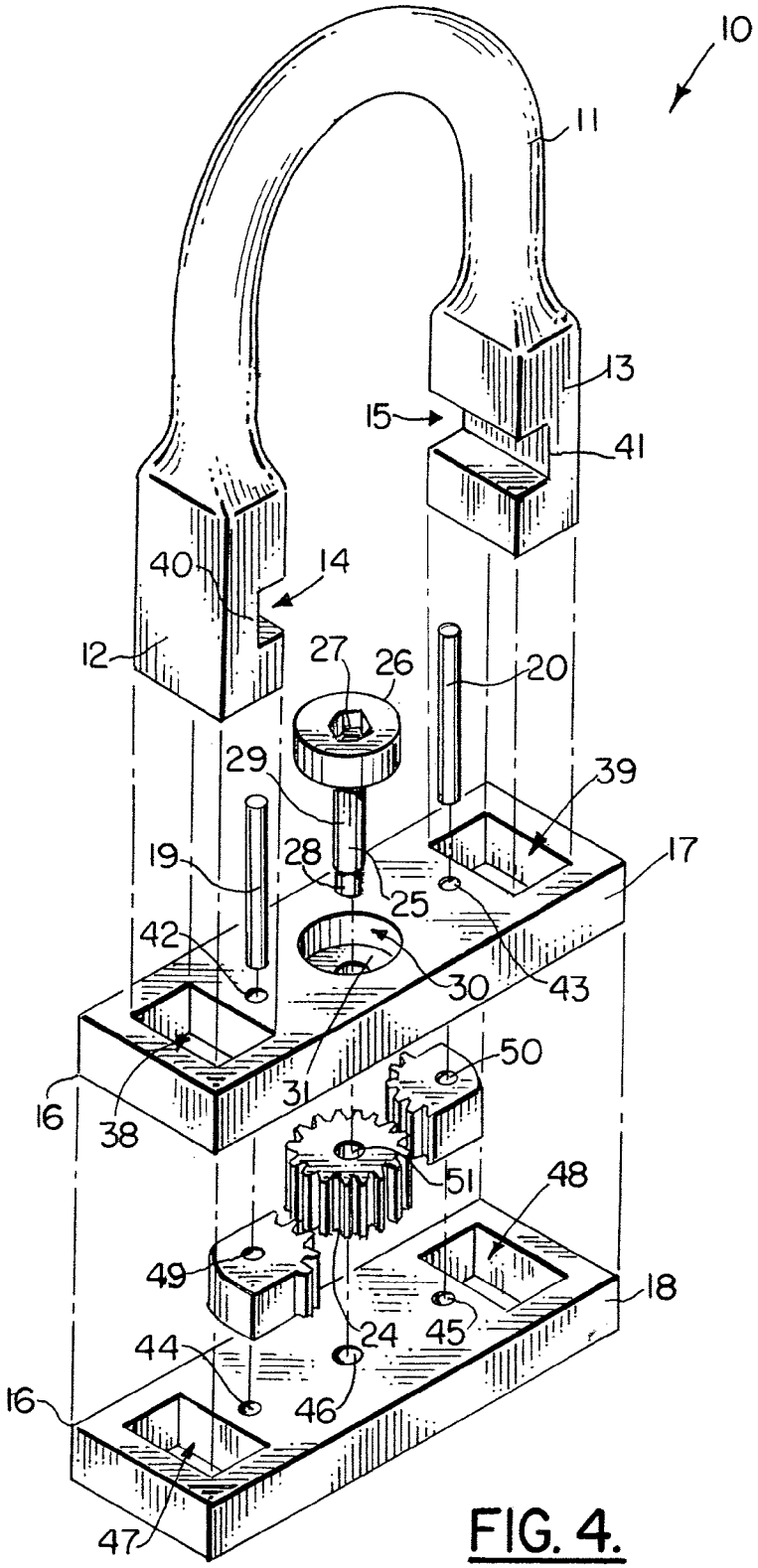
FIG. 4 is an exploded perspective view of the preferred embodiment of the apparatus of the present invention.
Figure 5:
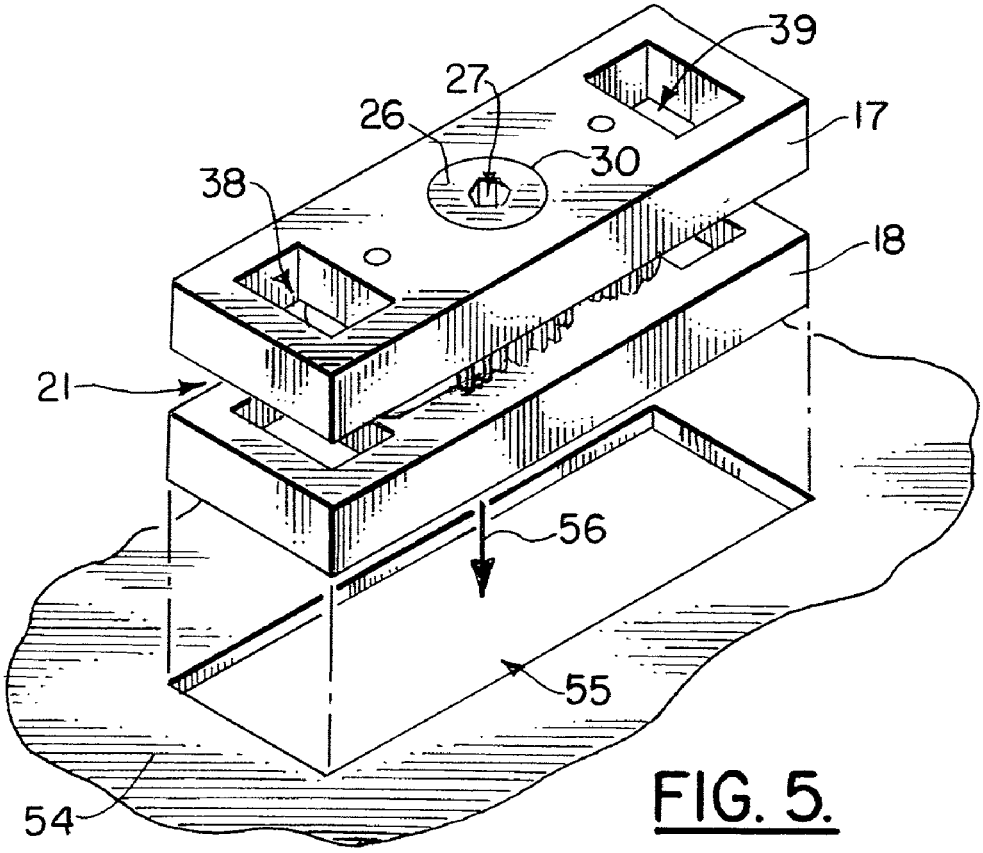
FIG. 5 is a fragmentary perspective exploded view of the preferred embodiment of the apparatus of the present invention shown attached to a section of plate.

A pin assembly 16 is provided that detachably connects to the bow 11. The pin assembly 16 in FIGS. 1-4 includes an upper plate 17, a lower plate 18 and connecting pins 19, that hold the plates 17, 18 in a spaced apart relation with a gap 21 therebetween as shown in FIGS. 1 and 5.

Figure 3:
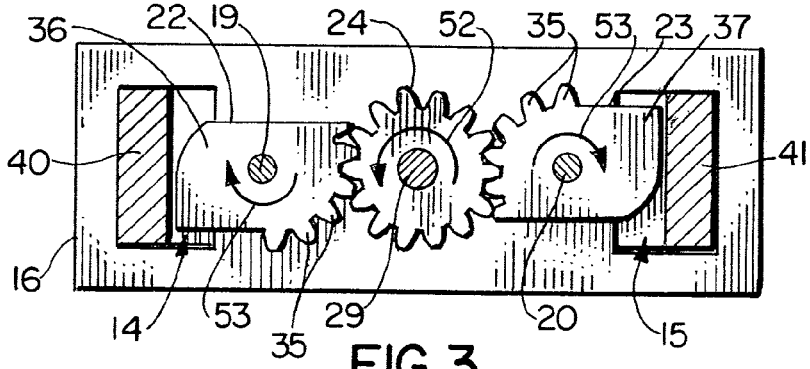
FIG. 3 is a sectional view taken along lines 3-3 of FIG. 1.

In order to secure the bow 11 to the pin assembly 16, a pair of locking members 22, 23 are provided. The locking members 22, 23 are rotatably mounted to pins 19, 20 at openings 49, 50 (see FIG. 4). The locking members 22, 23 rotate between an unlocked position (FIG. 2) and a locking position (FIG. 3). In order to rotate the locking members 22, 23 between the positions of FIGS. 2 and 3, a pinion gear 24 is provided that intermeshes with peripheral teeth 34, 35 on the locking members 22, 23.

Pinion gear 24 is mounted upon middle section 29 of drive shaft 25. In FIG. 4, the drive shaft 25 has an enlarged diameter upper end portion 26, a cylindrically shaped middle section 29, and a cylindrically shaped smaller diameter lower end portion 28. The larger diameter upper end portion 26 can provide a hexagonal socket 27 or other shaped socket that is receptive of a tool such as allen wrench 33 for rotating the drive shaft 25 and the pinion gear 24 attached thereto.

Upper plate 17 has a socket 30 that is receptive of larger diameter end portion 26 of drive shaft 25. Opening 32 enables middle section 29 of drive shaft 25 to pass through plate 17. The drive shaft 25 extends through opening 51 of pinion gear 24. Smaller diameter end 28 registers in opening 46 and lower plate 18. Socket 30 terminates in a circular plate 31 for holding larger diameter end portion 26 of drive shaft 25 during use.

Each of the locking members 22, 23 has a projecting portion that engages the slots of the bow ends during use. Thus, the projecting portion 36 of locking member 22 engages slot 14 of bow end 12. Similarly, the projecting portion 37 of locking member 23 engages the slot 15 of bow end 13, as shown in FIG. 3, when the pinion gear 24 is rotated to the locking position of FIG. 3.

Teeth 34, 35 of locking members 22, 23 engage pinion gear 24. The plate 17 has openings 38, 39 that enable bow end portions 12, 13 respectively to pass through plate 17 so that the slots 14, 15 align with locking members 32, 33, as shown in FIG. 1. A portion of the bow ends 12, 13 below slots 14, 15 extends into openings 47, 48 in lower plate 18. This configuration can be seen in FIG. 1. Openings 42, 43 in plate 17 enable pins 19, 20 to be attached thereto such as with welding. Similarly, openings 44, 45 in plate 18 are receptive of pins 19, 20, the pins being attached to the plate 18 at the openings 44, 45 using welding for example.

Arrow 52 in FIG. 3 illustrates a rotation of pinion gear 24 for rotating the locking members 22, 23 to the locking position of FIG. 3. Arrows 53 indicate schematically the rotation of the locking members 22, 23 when they are rotated by the pinion gear 24 into the locking position of FIG. 3.

Figure 6:
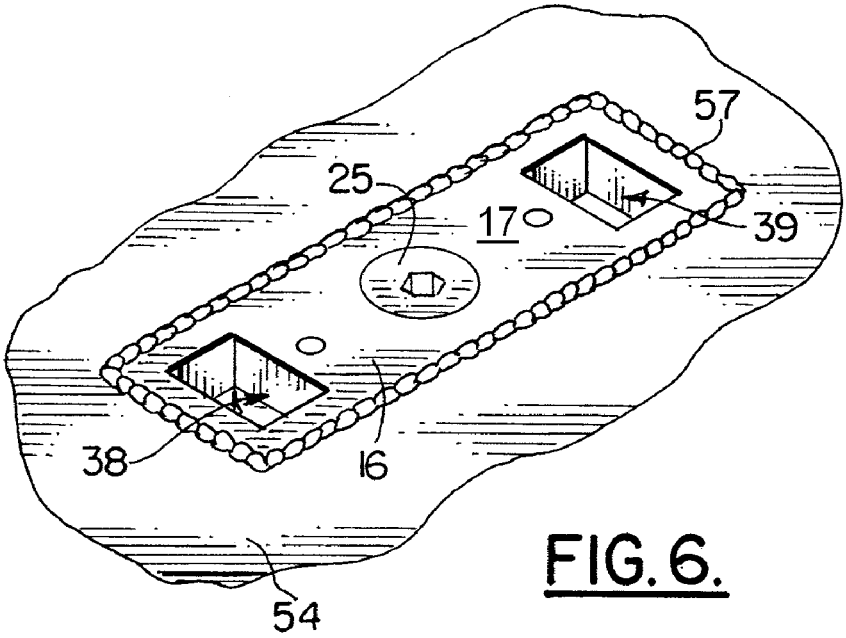
FIG. 6 is a perspective view of the preferred embodiment of the apparatus of the present invention shown attached to a section of plate.
Figure 7:
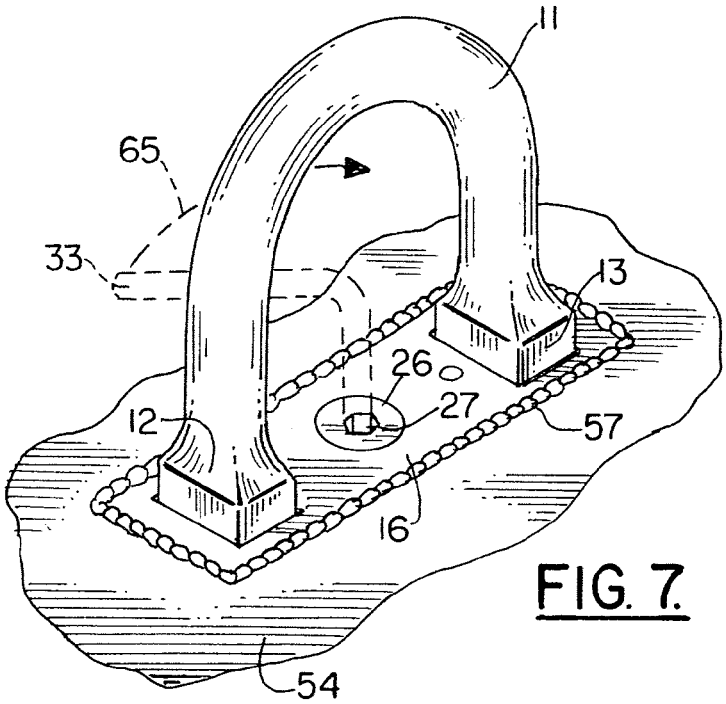
FIG. 7 is a perspective view of the preferred embodiment of the apparatus of the present invention illustrating attachment to a section of plate.

In FIGS. 5-6, a plate or deck 54 (e.g. boat deck, platform deck) is shown to which the pin assembly 16 can be attached such as with welding. In this fashion, the bow 11 can function as a padeye or anchor. The plate 54 has plate opening 55 formed in a plate or deck 54. Arrow 56 schematically illustrates the lowering of pin assembly 16 into opening 55. A weld 57 can be used to join upper plate 17 and thus pin assembly 16 to plate 54. In FIG. 7, the pin assembly 16 is shown welded to plate 54 with bow 11 and its end portions 12, 13 shown interlocked with pin assembly 16. Allen wrench 33 shown in phantom lines wherein arrow 65 schematically illustrates a rotation of the allen wrench 33 in order to release the bow 11 from the pin assembly 16.

Figure 8:
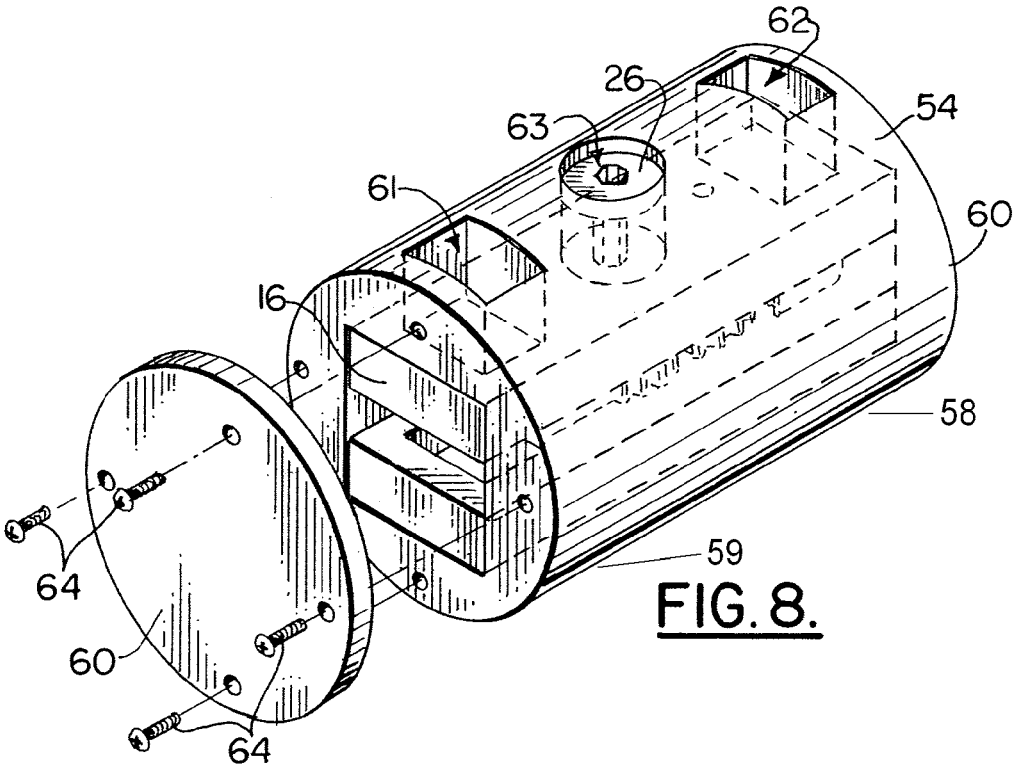
FIG. 8 is a perspective view of the preferred embodiment of the apparatus of the present invention showing the pin assembly encapsulated in a protective case.
Figure 9:
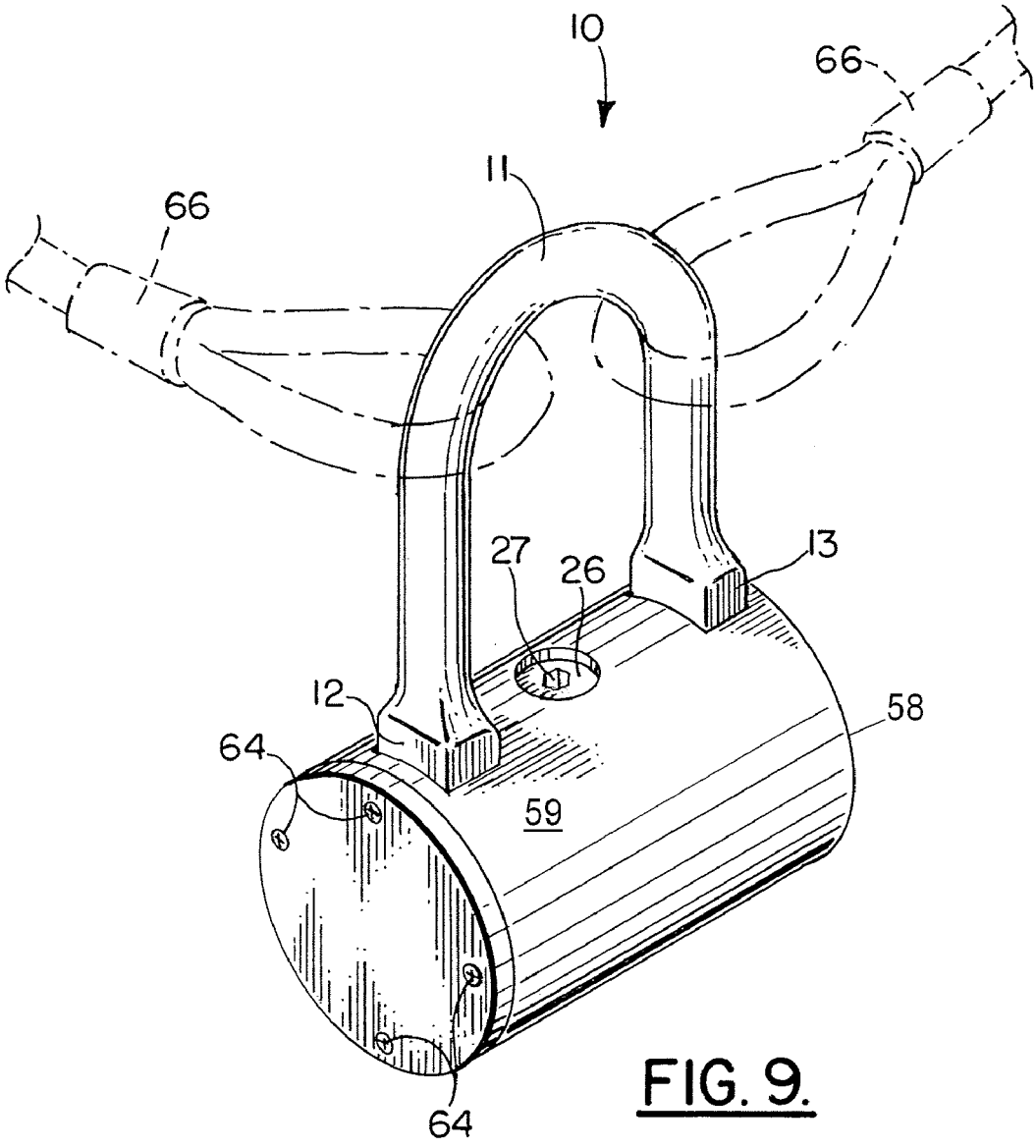
FIG. 9 is a perspective view of the preferred embodiment of the apparatus of the present invention showing the pin assembly encapsulated in a protective case.

FIGS. 8 and 9 illustrate that pin assembly 16 can be protectively contained within a case 58. The case 58 can provide a cylindrical side wall 59 and opposed end caps 60. Each end cap 60 can be removably attached to the cylindrical side wall 59 using fasteners 64. Openings 61, 62 in cylindrical side wall 59 enable the ends 12, 13 of bow 11 to pass through wall 59 and engage the openings 38, 39, 47, 48 of the plates 17, 18. Opening 63 affords access to drive shaft 25. The case 58 of FIGS. 8-9 can be made very strong and of a thick material so that the pin assembly 16 is protected during use. The bow 11 can be rigged to a pair of slings 66 (or other rigging, tie-down, strap or cable) as shown in FIG. 9 which subject shackle apparatus 10 to high loads.

Figure 16:
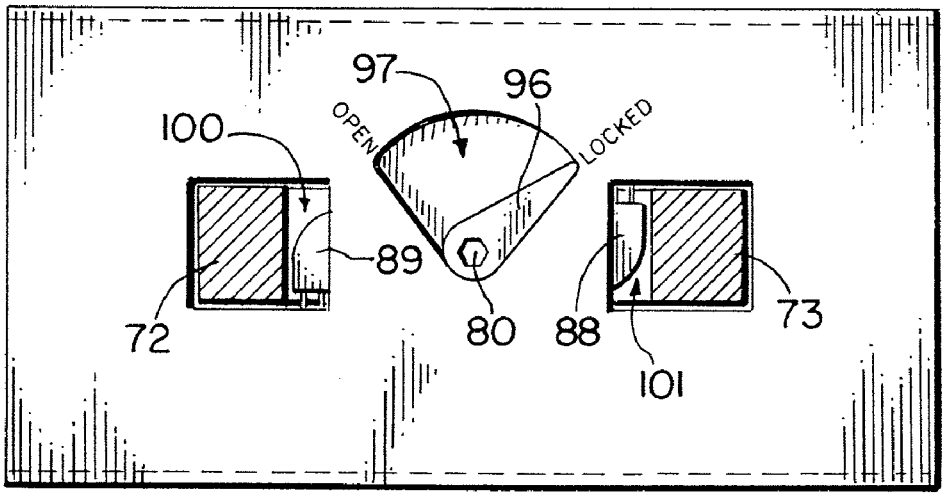
FIG. 16 is a sectional view taken along lines 16-16 of FIG. 14.

FIGS. 10-16 show an alternate embodiment of the apparatus of the present invention designated generally by the numeral 70. Shackle apparatus 70 provides a bow 71 having bow ends 72, 73. Each bow end provides a slot. The bow end 72 has slot 74. The bow end 73 has slot 75. The bow 71 forms a connection with housing 76. In the embodiment of FIGS. 10-16, the interlocking arrangement between the bow 71 and the housing 76 is similar to that locking arrangement provided with the preferred embodiment of FIGS. 1-9. The embodiment of FIGS. 10-16 is spring loaded so that when the indicator lever 96 is moved from a locked position that is shown in FIG. 16 to an open position (FIG. 12), spring action pushes the bow 71 upwardly, quick releasing it from the housing 76.

Housing 76 provides an interior 77 that contains locking mechanism 78. Locking mechanism 78 includes a plate 79 that is attached to the housing 76 with a plurality of pins 80, 81, 82. Pinion gear 111 rotates upon shaft 80. Lug 83 rotates upon shaft 81. Lug 84 rotates upon pin 82. The pinion gear 111 provides a plurality of circumferentially spaced apart radially extending teeth 85. The lug 83 has teeth 86. The lug 84 has teeth 87.

Figure 11:
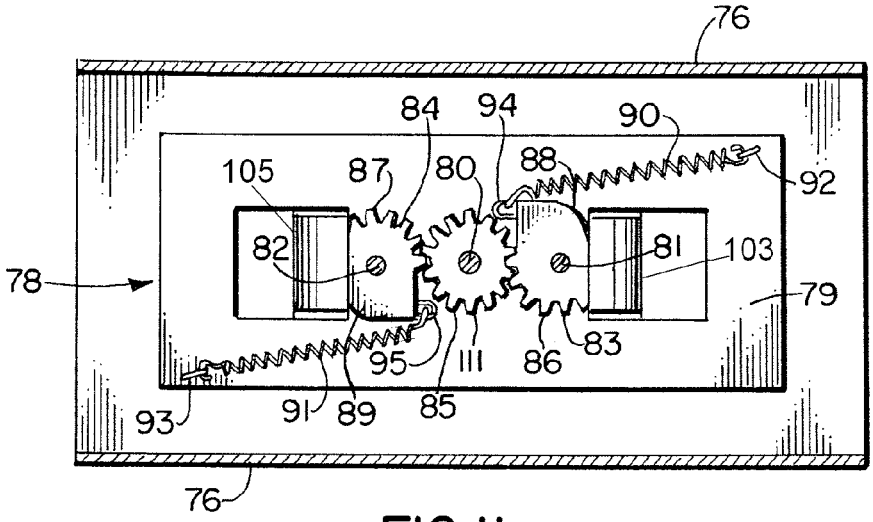
FIG. 11 is a sectional view taken along lines 11-11 of FIG. 10.

Each of the lugs has a projection that interlocks with a slot 74, 75 of bow 71. The lug 83 provides projection 88 that interlocks with slot 75 when bow 71 is pushed into the openings 100, 101 in housing 76 (see FIG. 16). Similarly, the lug 84 provides a projection 89 that interlocks with slot 74 of bow end 72. This interlocked position of the projections 88, 89 with the slots 74, 75 can be seen in FIG. 15. Springs 90, 91 urge the lugs 83, 84 toward the locking position of FIG. 15. The spring 90 is anchored to plate 79 with anchor 92. The spring 91 is anchored to plate 79 with anchor 93. Eyelets are provided for connecting each of the springs 90, 91 to a lug 83, 84. Lug 83 provides spring eyelet 94. Lug 84 provides spring eyelet 95 as shown in FIG. 11.

Figure 12:
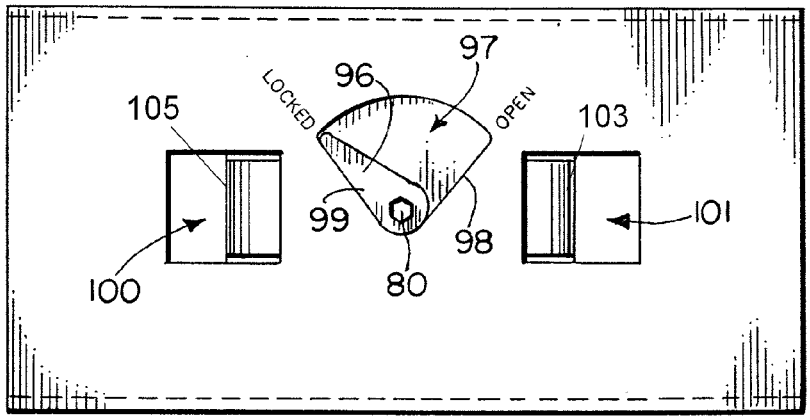
FIG. 12 is a sectional view taken along lines 12-12 of FIG. 10.
Figure 13:
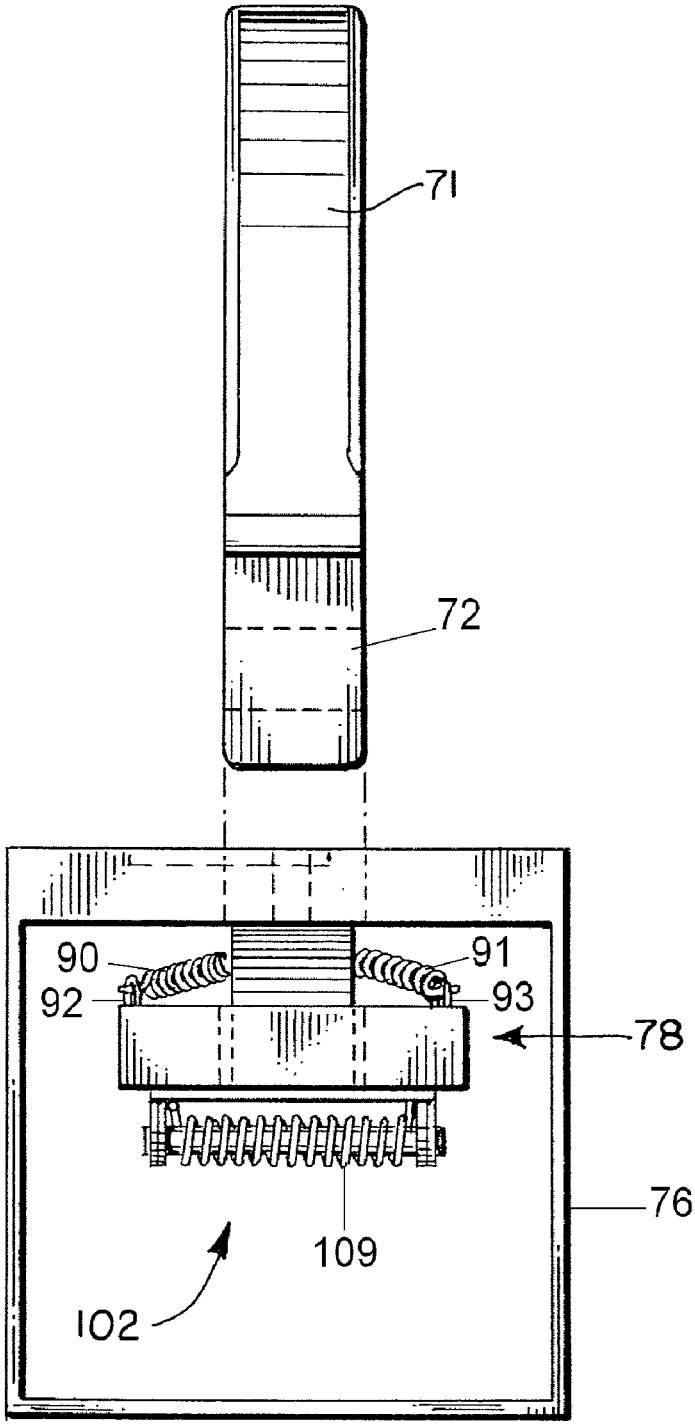
FIG. 13 is a sectional view taken along lines 13-13 of FIG. 10.
Figure 14:
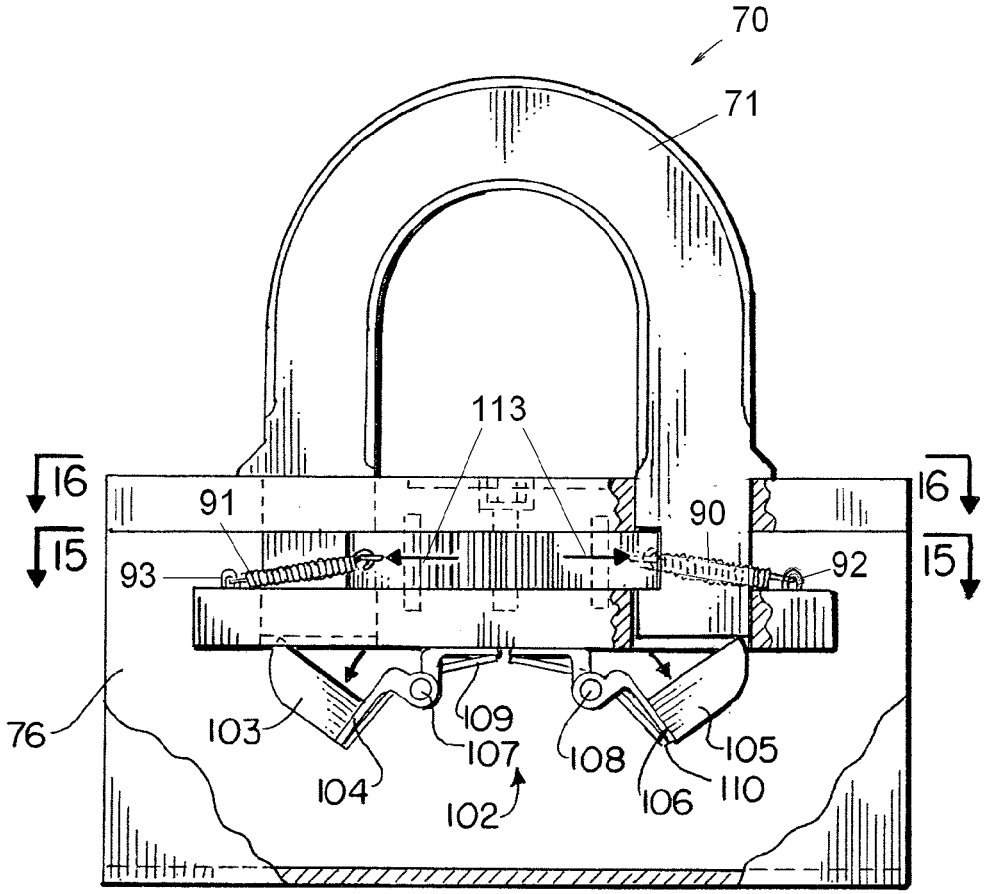
FIG. 14 is a sectional elevation view of the alternate embodiment of the apparatus of the present invention showing the bow in a locked position.
Figure 15:
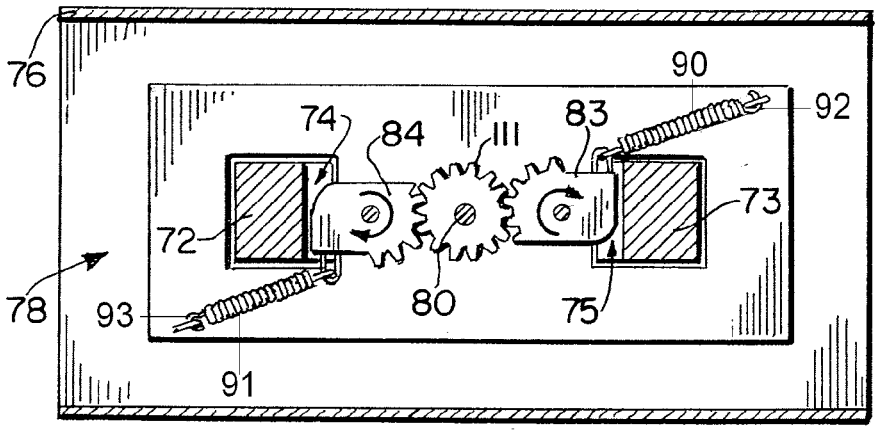
FIG. 15 is a sectional view taken along lines 15-15 of FIG. 14.

In order to release the bow 71 from housing 76, indicator lever 96 is moved from a locked position as shown in FIG. 16 to an unlocked or open position as shown in FIG. 12. When this occurs, the indicator lever 96 travels in a recess 97 between stops 98, 99. Stop 98 prevents the lever 96 from traveling within recess 97 and beyond the stop 98. Similarly, the stop 99 prevents the lever 96 from traveling within recess 97 and beyond the stop 99 as shown in FIGS. 12 and 16. When the lever 96 is moved to the open position of FIG. 12, the tension provided by springs 90, 91 is overcome. An ejection spring assembly 102 ejects bow 71 when the lever 96 is moved from the locked position of FIG. 16 to the open position of FIG. 12. The ejection spring assembly 102 can include for example a pair of shaped levers 103, 105 each attached to a plate. The lever 103 attaches to plate 104. The lever 105 attaches to plate 106. The plates 104, 106 are pivotally attached to shafts 107, 108 respectively. Likewise, a coil spring 109, 110 is attached to each of the shafts 107, 108 respectively. The spring 109 attaches to shaft 107. The spring 110 attaches to shaft 108.

Figure 10:
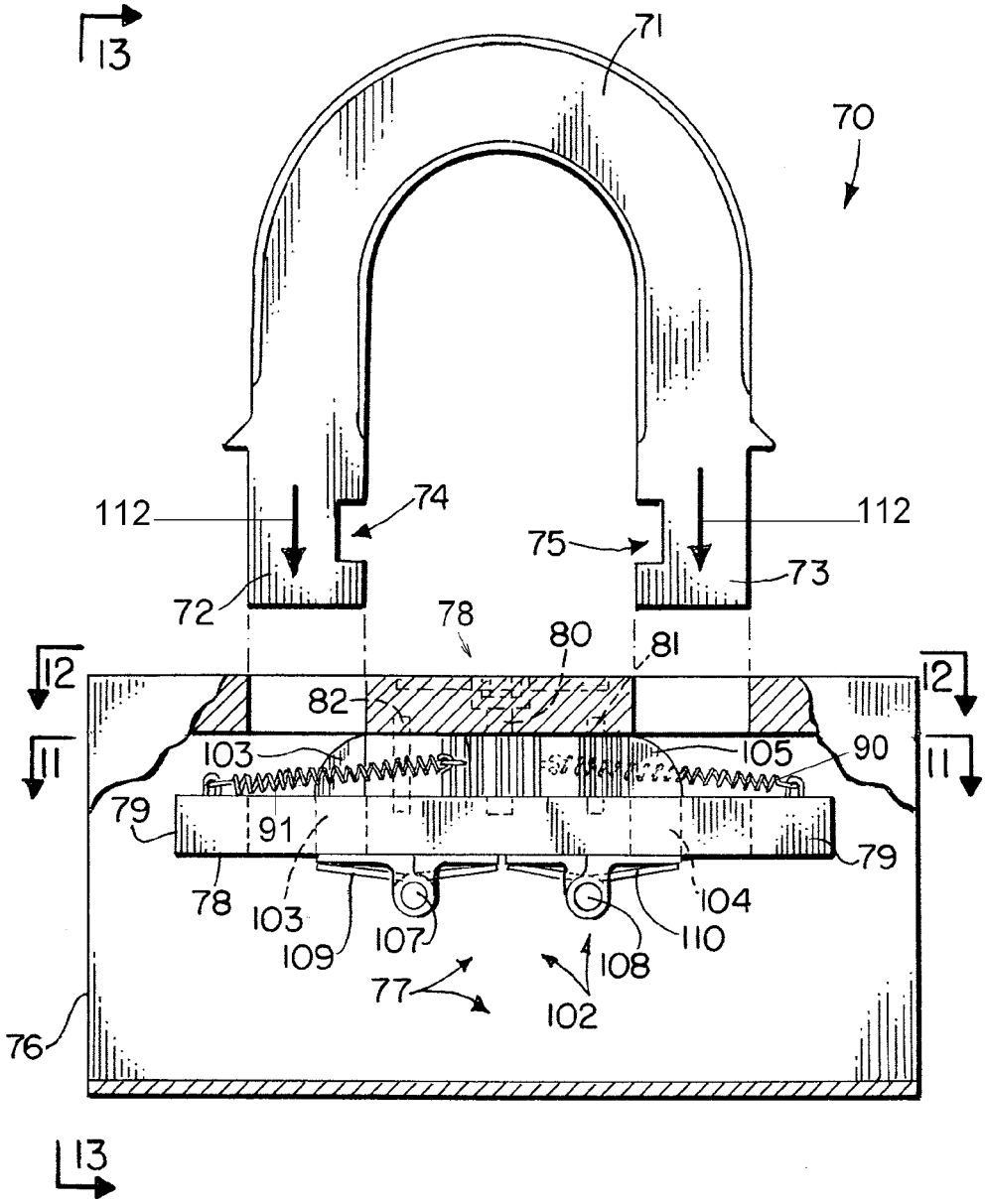
FIG. 10 is a sectional elevation exploded view of an alternate embodiment of the apparatus of the present invention.

When the bow 71 is locked to the housing 76, a user simply pushes the bow downwardly in the direction of arrows 112 in FIG. 10. The ends 72, 73 of bow 71 engage the shaped levers 103, 105 pushing them downwardly against the ejection spring assembly 102 until the levers 103, 105 assume the position of FIG. 14. As the bow 71 ends 72, 73 push the shaped levers 103, 105 away from lugs 83, 84, the lugs 83, 84 move outwardly in the direction of arrows 113 (FIG. 14) and engage the slots 74, 75 at the ends 72, 73 of bow 71.

Figure 17:
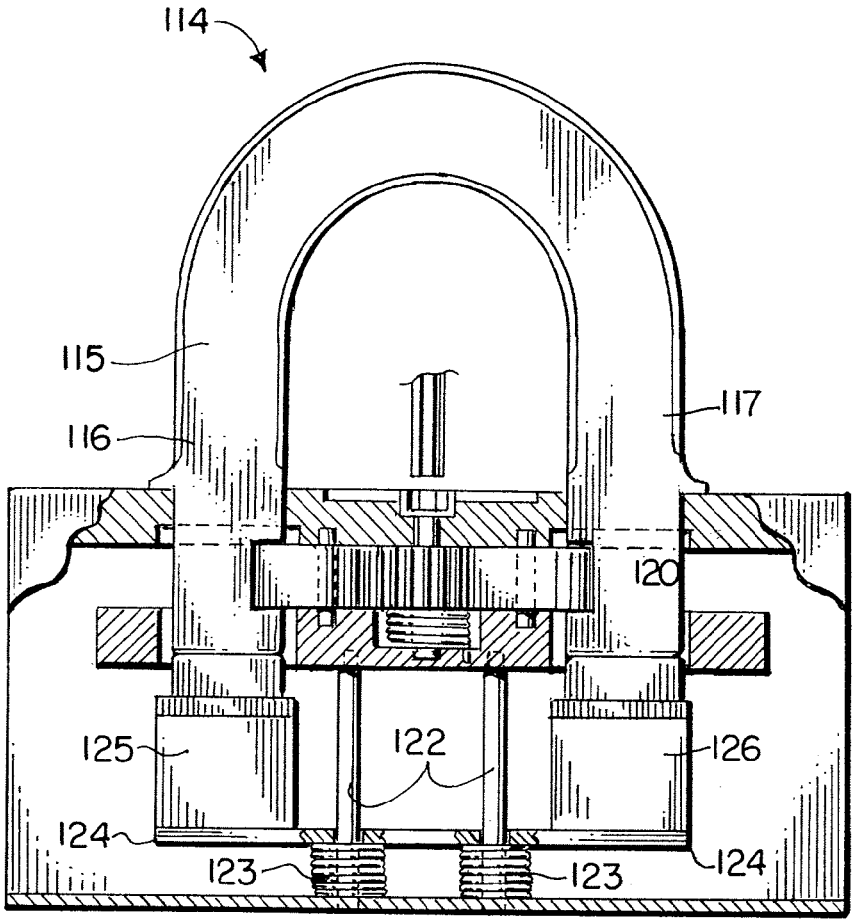
FIG. 17 is a sectional elevation view of a third embodiment of the apparatus of the present invention.
Figure 18:
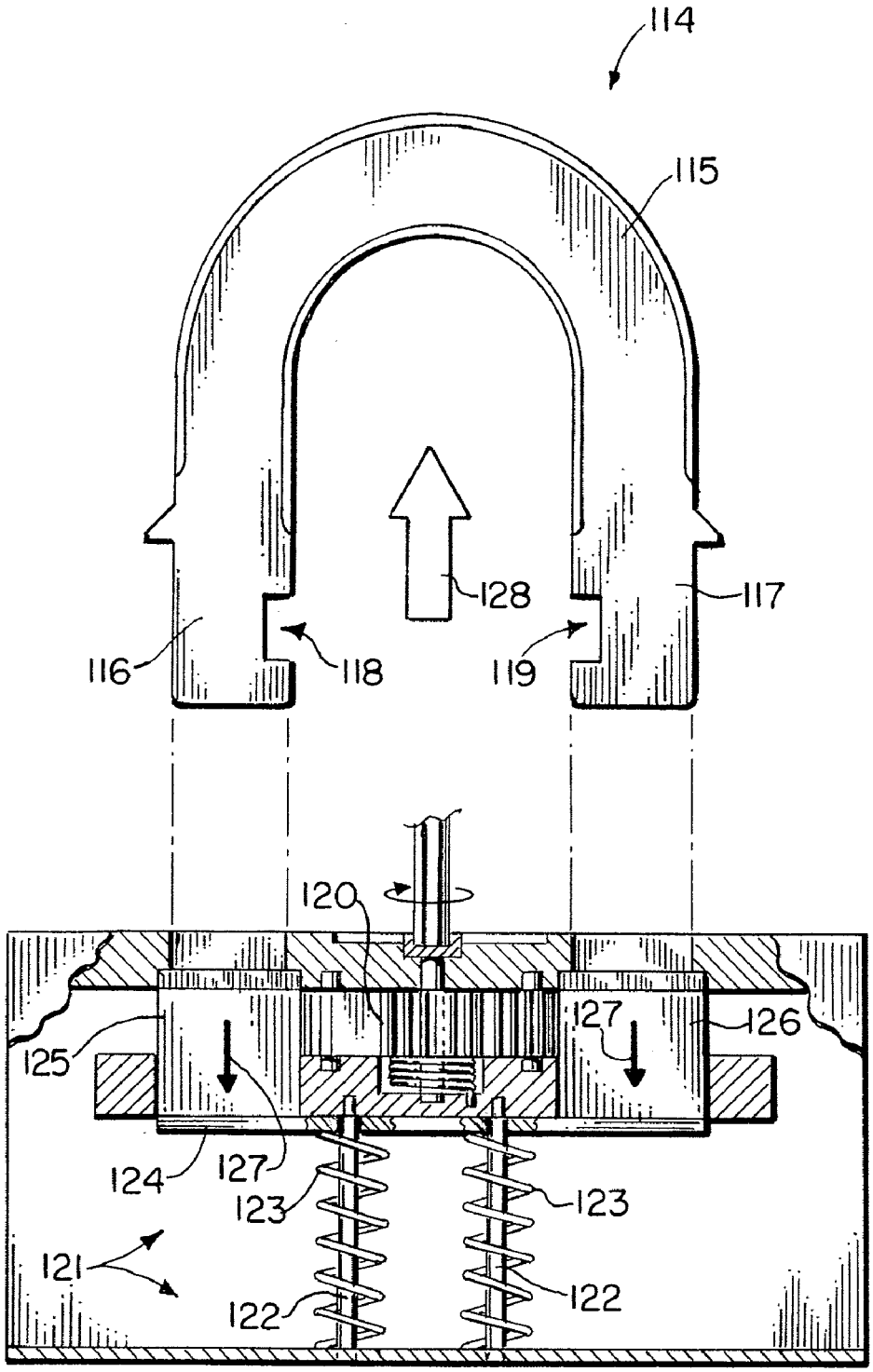
FIG. 18 is a sectional elevation view of a third embodiment of the apparatus of the present invention.

In FIGS. 17 and 18, shackle 114 provides a bow 115 having ends 116, 117. Each end 116, 117 provides a slot. The end 116 has slot 118. The end 117 has slot 119. Shackle 114 provides a lock mechanism 120 that can be any of the lock mechanisms shown in FIGS. 1-16. In the embodiment of FIGS. 17-18, a spring assembly 121 is provided for sealing the openings (such as openings 38, 39 or 61, 62 or 100, 101) when the shackle bow 115 is separated from the locking mechanism 120 as indicated by arrows 127, 128 in FIG. 18.

The spring assembly 121 provides a pair of pins 122 that are attached to plate 124. Coil springs 123 extend about each pin 122 and extend in between the plate 124 and a pin assembly 16 or housing 76. A pair of plugs 125, 126 are provided for sealing the openings when the bow separates from the pin assembly or housing 16. This upward movement of the plate 124 and plugs 125, 126 seals the openings (e.g. 38, 39 or 61, 62 or 100, 101) as indicated schematically by the arrows 127 in FIG. 18.

Figure 19:
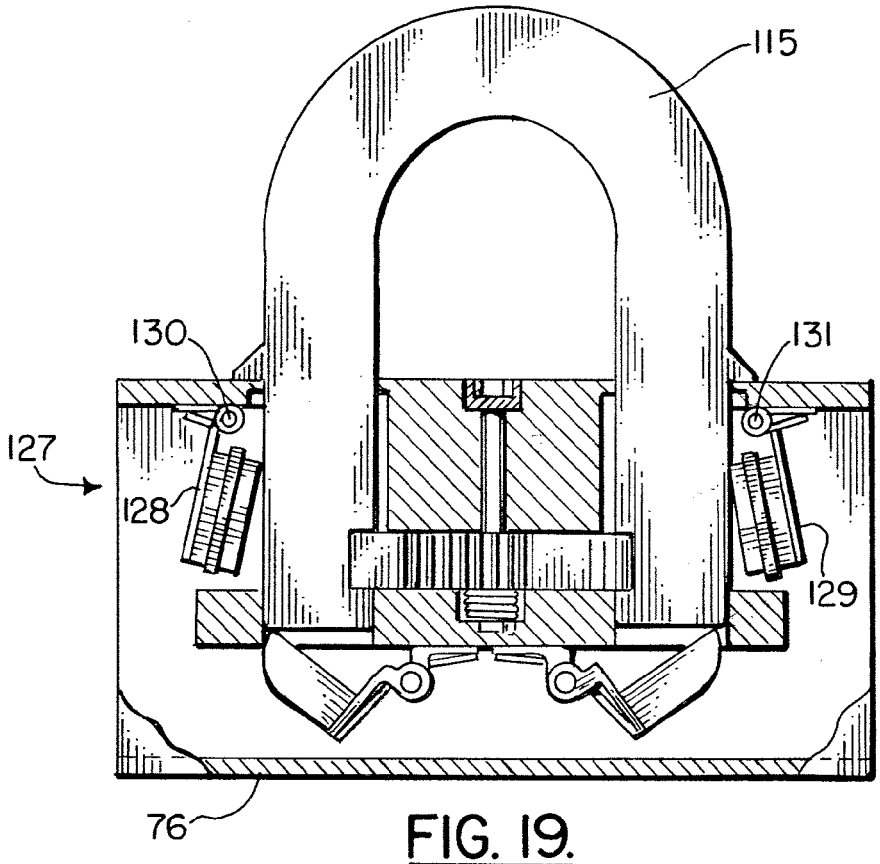
FIG. 19 is a sectional elevation view of a fourth embodiment of the apparatus of the present invention.
Figure 20:
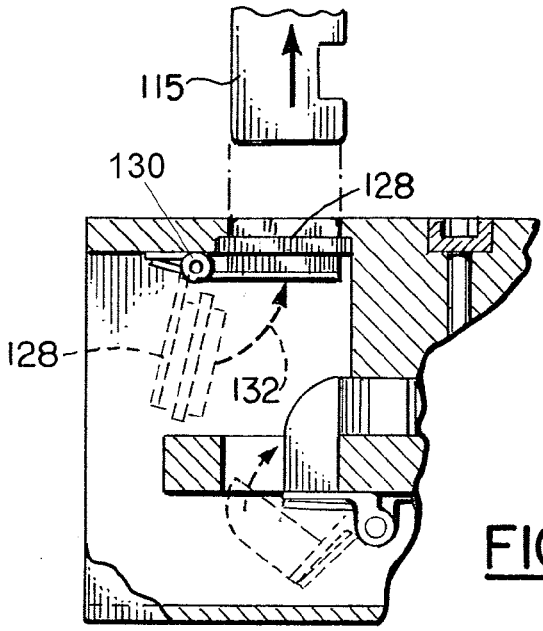
FIG. 20 is a sectional elevation view of a fourth embodiment of the apparatus of the present invention.

In FIGS. 19-20, an alternate spring assembly 127 is shown that features plugs 128, 129 each being pivotally attached to housing 76 using pivots 130, 131. The embodiment of FIGS. 19 and 20 is an optional embodiment that can be used with the shackle arrangement of FIGS. 10-16. In FIG. 20, each plug 128 is shown in an open position in phantom lines and rotating to a closed position which is shown in hard lines, pivotal movement of the plug 128 being schematically illustrated by the curved arrow 132.

FIGS. 21-24 show alternate arrangements for a shackle bow and pin arrangement.

Figure 21:
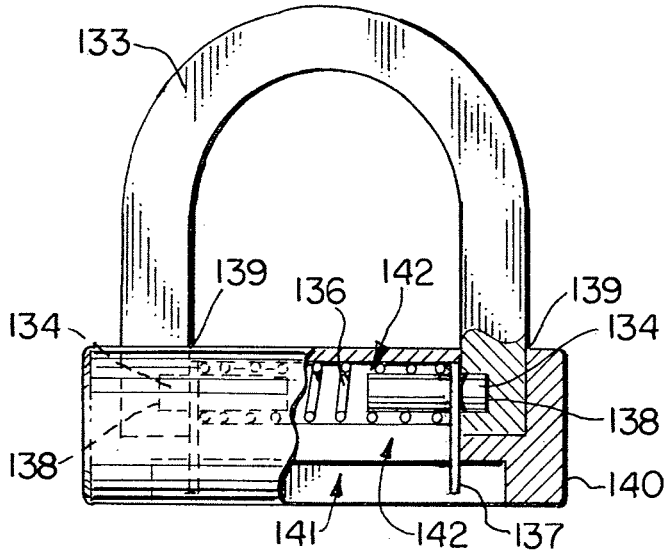
FIGS. 21-24 are perspective views showing alternate spring locking arrangements for the shackle bow.
Figure 22:
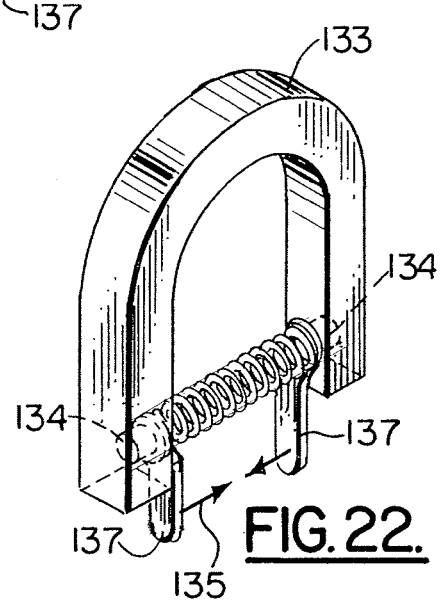

In FIGS. 21-24, alternate arrangements are shown for providing an interface locking arrangement between a shackle bow and a housing or body. In FIGS. 21 and 22, bow 133 has locking members 134 in the form of cylindrically shaped pins that are received by sockets 138 at the ends of the bow 38 as shown in FIG. 21. Spring 136 urges the locking members 134 into a locking engagement with sockets 138. The spring 136 can be overcome as indicated by arrow 135 in FIG. 22 by moving the handles 137 in the direction of arrows 135. Openings 139 in housing 140 enable the ends of bow 133 to be inserted into body 140 and the position of FIG. 21. A user would simply move the handles 137 toward each other in the direction of arrow 135 until the bow 133 occupied the position shown in FIG. 21 relative to openings 139 and body 140. A user would then release the handles 137 so that the spring 136 moves the locking members 134 into sockets 138 forming a connection between bow 133 and body or housing 140.

Figure 23:
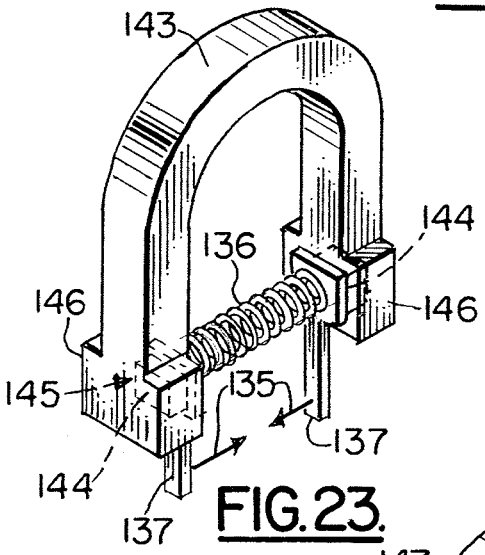
Figure 24:
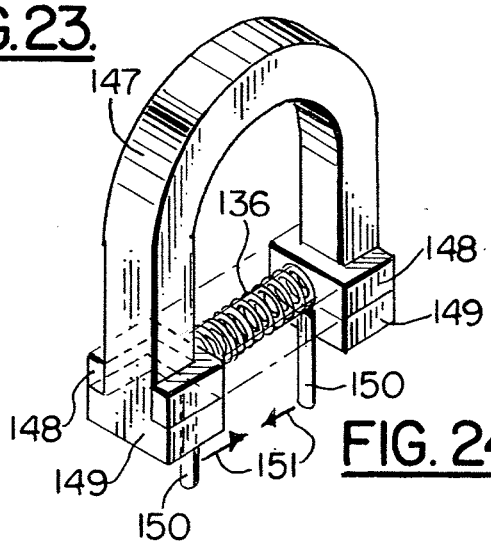
Figure 25:
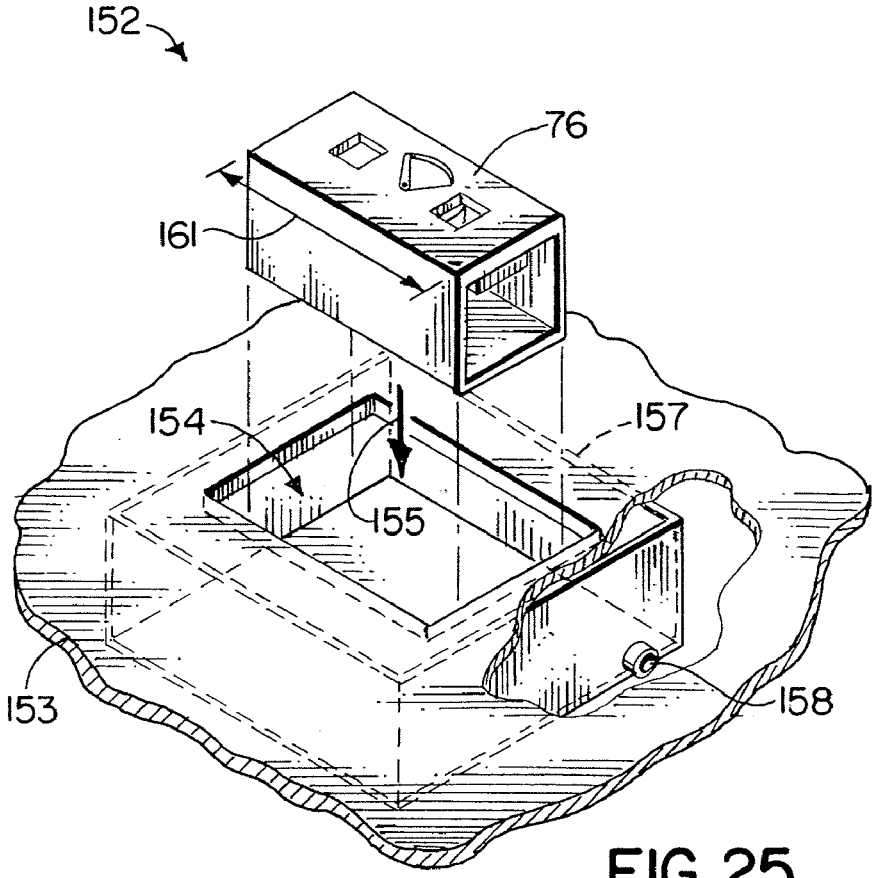
FIGS. 25-28 are sequential views illustrating a connection for attaching the shackle apparatus of the present invention to a deck such as a vessel deck.
Figure 26:
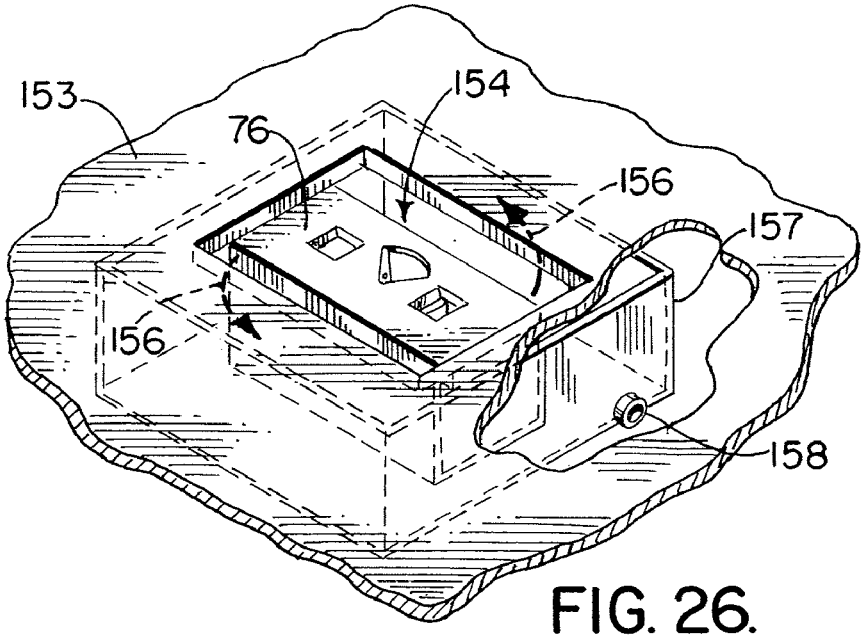

Other locking arrangements could be used such as those shown in FIGS. 23 and 24. In each case, the body or housing 140 provides an interior 142 for receiving the locking members, spring and handles 144. The body 140 would also provide a slot 141 for enabling a user to grip the handles 137, 150 using a thumb and forefinger for example. For larger shackles, the user would grip both of the handles 137 and move them together in the direction of arrow 135.

In FIG. 23, bow 143 has locking members 144 that engage enlarged ends 146 of bow 143 using handles 137. The handles 137 would be attached to the locking members 144, both moved together as shown by arrows 135. Sockets 145 could be squared to receive the squared locking members 144. Handles 137 could be moved in the direction of arrows 135 as shown in FIG. 23 to disengage the locking members 144 from the sockets 145 of bow 143.

In FIG. 24, a bow 147 has unshaped locking members 148 that engage the enlarged ends 149 of the bow 147 as shown. Handles 150 would be moved in the direction of arrows 151 for releasing the unshaped locking members 148 from the enlarged ends 149 of the bow 147.

Figure 27:
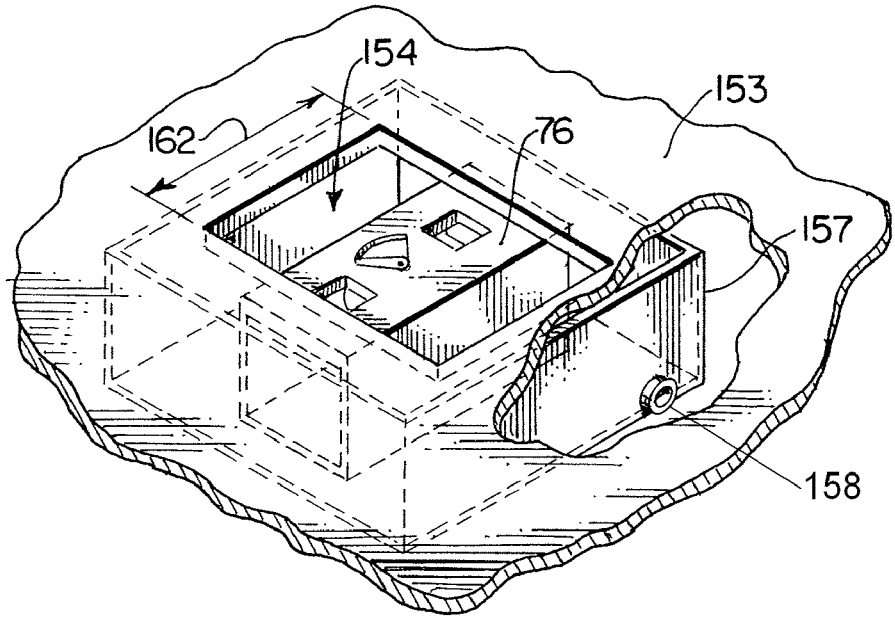
Figure 28:
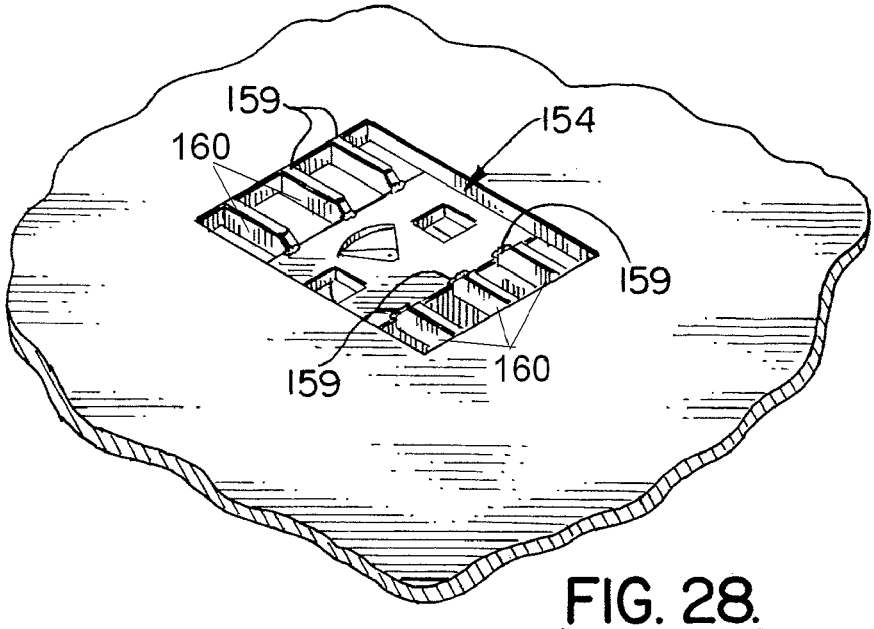

In FIGS. 25-28 there is shown an arrangement for mounting any one of the shackle apparatus of the present invention to an under deck area of a marine vessel, offshore oil production or oil drilling platform, offshore structure, or the like structure. In FIGS. 25-28, the shackle 152 and deck arrangement can be used for example with the housing 76 of FIG. 10. Deck 153 can be an oil platform or like deck, a boat deck or other deck to which a shackle would be desirably connected. Deck 153 provides deck opening 154. Housing 76 is lowered through opening 154 as indicated by arrow 155. Once below deck 153, housing 76 is rotated in the direction of arrows 156 until it reaches the position shown in FIG. 27. In this position, the housing 76 length 161 is a dimension that is greater than the width 162 of the opening 154 as seen in FIG. 27. An under deck receptacle 157 having a drain line 158 can be provided around the housing 76. Plates 160 can be used to hold the housing 76 in position with a plurality of tack weldments 159 as shown.

Figure 29:
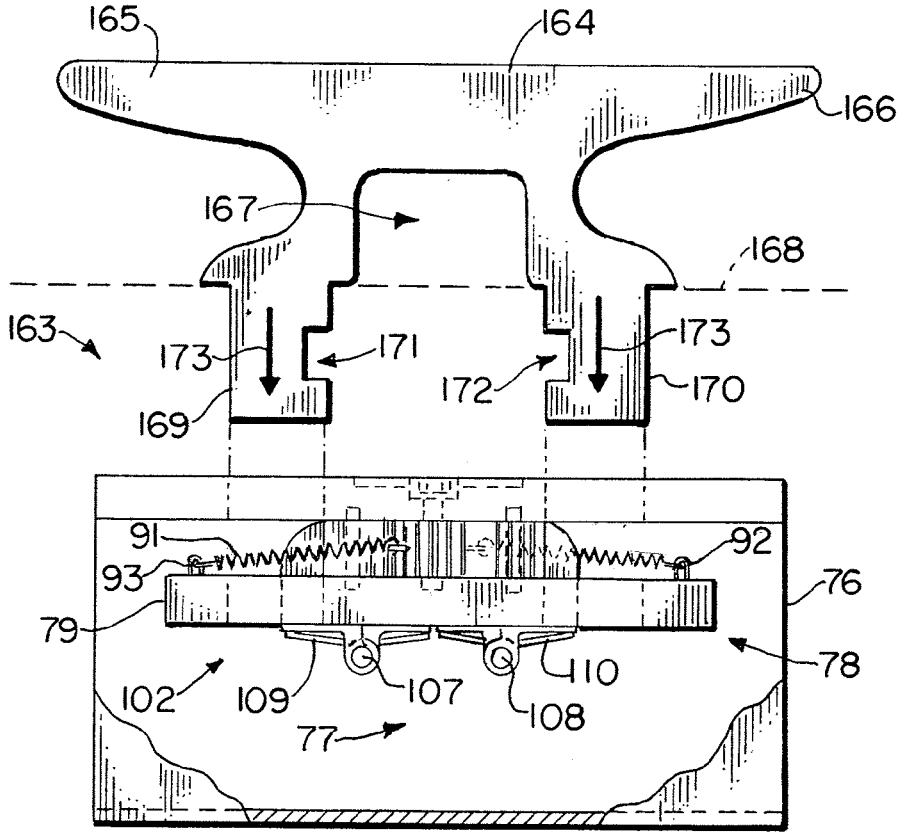
FIGS. 29-30 are elevation views of another embodiment of the apparatus of the present invention in the form of a cleat.
Figure 30:
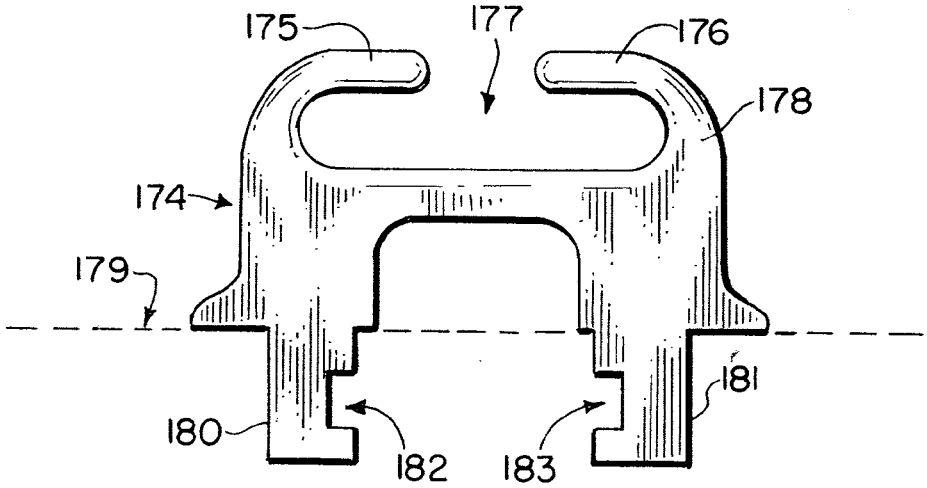

FIGS. 29 and 30 show cleat configurations. For each of these cleat configurations of FIGS. 29-30, a cleat body 164 or 174 can be interlocked with the same housing 76 and contained locking mechanism 78 as with the shackle arrangement of FIGS. 10-16. Cleat 163 provides cleat body 164 that has projections 165, 166. A space 167 is provided under projections 165, 166 and above reference line 168. The reference line 168 is a line that fits snuggly against housing 76 when cleat body 164 is combined with housing 76 and locking mechanism 78. In that regard, the cleat body 164 can be provide ends 169, 170 that are configured like the ends 72, 73 of the embodiment of FIGS. 10-16. Each end 169, 170 has a recess. The cleat body end 169 provides recess 171. The cleat end 170 provides recess 172. Arrows 173 are analogous to arrows 112 in FIG. 10 in that they indicate a connection being formed when cleat body 164 is moved downwardly in the direction of arrows 163 for interlocking with housing 76 and its locking mechanism 78.

Similarly, cleat 174 in FIG. 30 provides a cleat body 178 having projections 175, 176 with a space 177 therebetween. Reference line 179 extends horizontally and above cleat ends 180, 181. The cleat end 180 provides recess 182. The cleat end 181 provides recess 183. Each of the cleat bodies 164, 178 interlocks with housing 76 and locking mechanism 78 in the same manner that a shackle bow 71 so interlocks as shown and described with respect to the embodiment of FIGS. 10-16.

The following is a list of parts and materials suitable for use in the present invention.

PARTS LIST

| Part Number | Description |
|---|---|
| 10 | shackle |
| 11 | bow |
| 12 | bow end |
| 13 | bow end |
| 14 | slot |
| 15 | slot |
| 16 | pin assembly or housing |
| 17 | plate |
| 18 | plate |
| 19 | pin |
| 20 | pin |
| 21 | gap |
| 22 | locking member |
| 23 | locking member |
| 24 | pinion gear |
| 25 | drive shaft |
| 26 | larger diameter upper end portion |
| 27 | hexagonal socket |
| 28 | smaller diameter lower end portion |
| 29 | middle section |
| 30 | cylindrical socket |
| 31 | circular plate |
| 32 | opening |
| 33 | allen wrench |
| 34 | peripheral teeth |
| 35 | peripheral teeth |
| 36 | projecting portion |
| 37 | projecting portion |
| 38 | opening |
| 39 | opening |
| 40 | narrow part |
| 41 | narrow part |
| 42 | opening |
| 43 | opening |
| 44 | opening |
| 45 | opening |
| 46 | opening |
| 47 | opening |
| 48 | opening |
| 49 | opening |
| 50 | opening |
| 51 | opening |
| 52 | arrow |
| 53 | arrow |
| 54 | plate |
| 55 | opening |
| 56 | arrow |
| 57 | weld |
| 58 | case |
| 59 | cylindrical side wall |
| 60 | end cap |
| 61 | opening |
| 62 | opening |
| 63 | opening |
| 64 | fasteners |
| 65 | arrow |
| 66 | sling |
| 70 | shackle |
| 71 | bow |
| 72 | bow end |
| 73 | bow end |
| 74 | slot |
| 75 | slot |
| 76 | housing |
| 77 | interior |
| 78 | locking mechanism |
| 79 | plate |
| 80 | pin |
| 81 | pin |
| 82 | pin |
| 83 | lug |

-continued

PARTS LIST

| Part Number | Description |
|---|---|
| 84 | lug |
| 85 | tooth |
| 86 | tooth |
| 87 | tooth |
| 88 | projection |
| 89 | projection |
| 90 | spring |
| 91 | spring |
| 92 | anchor |
| 93 | anchor |
| 94 | eyelet |
| 95 | eyelet |
| 96 | indicator lever |
| 97 | recess |
| 98 | stop |
| 99 | stop |
| 100 | opening |
| 101 | opening |
| 102 | ejection spring assembly |
| 103 | shaped lever |
| 104 | plate |
| 105 | shaped lever |
| 106 | plate |
| 107 | shaft |
| 108 | shaft |
| 109 | spring |
| 110 | spring |
| 111 | pinion gear |
| 112 | arrow |
| 113 | arrow |
| 114 | shackle |
| 115 | bow |
| 116 | bow end |
| 117 | bow end |
| 118 | slot |
| 119 | slot |
| 120 | lock mechanism |
| 121 | spring assembly |
| 122 | pin |
| 123 | spring |
| 124 | plate |
| 125 | plug |
| 126 | plug |
| 127 | spring assembly |
| 128 | plug |
| 129 | plug |
| 130 | pivot |
| 131 | pivot |
| 132 | arrow |
| 133 | bow |
| 134 | locking member |
| 135 | arrow |
| 136 | spring |
| 137 | handle |
| 138 | socket |
| 139 | opening |
| 140 | housing |
| 141 | slot |
| 142 | hollow interior |
| 143 | bow |
| 144 | locking member |
| 145 | socket |
| 146 | enlarged end |
| 147 | bow |
| 148 | u-shaped lock |
| 149 | enlarged end |
| 150 | handle |
| 151 | arrow |
| 152 | shackle |
| 153 | deck |
| 154 | deck opening |
| 155 | arrow |
| 156 | arrow |
| 157 | under deck receptacle |
| 158 | drain line |

-continued

| PARTS LIST | |
|---|---|
| Part Number | Description |
| 159 | tack weldments |
| 160 | plates |
| 161 | dimension arrow |
| 162 | dimension arrow |
| 163 | cleat |
| 164 | cleat body |
| 165 | projection |
| 166 | projection |
| 167 | space |
| 168 | reference line |
| 169 | end |
| 170 | end |
| 171 | recess |
| 172 | recess |
| 173 | arrow |
| 174 | cleat |
| 175 | projection |
| 176 | projection |
| 177 | open area |
| 178 | cleat body |
| 179 | reference line |
| 180 | end |
| 181 | end |
| 182 | recess |
| 183 | recess |

All measurements disclosed herein are at standard temperature and pressure, at sea level on Earth, unless indicated otherwise. All materials used or intended to be used in a human being are biocompatible, unless indicated otherwise.

The foregoing embodiments are presented by way of example only; the scope of the present invention is to be limited only by the following claims.

The invention claimed is:

1. A shackle apparatus comprising:

a) a bow having bow end portions, each bow end portion having a recess;

b) a pin assembly that detachably connects to the bow, the pin assembly having upper and lower end portions and including a frame having spaced apart plates with a pair of locking members therebetween, each locking member being pivotally attached to the frame, each locking member having a projecting portion that engages the recess of a bow end portion;

c) a pinion gear that engages the locking members, the pinion gear being rotatably mounted to the frame in between the plates and generally in between the locking members;

d) a rotatable drive shaft for rotating the pinion gear at the upper end portion of the pin assembly; and e) pins that hold the plates apart and wherein a locking member is mounted to a pin.

2. The shackle apparatus of claim 1 wherein the bow end portions have narrowed sections next to a recess.

3. The shackle apparatus of claim 1 wherein the bow recesses face inwardly, toward each other.

4. The shackle apparatus of claim 1 wherein the bow end portions are generally rectangular in transverse cross section.

5. The shackle apparatus of claim 1 wherein the bow end portions each register in openings in the plates.

6. The shackle apparatus of claim 4 wherein the openings are generally rectangular in shape.

7. The shackle apparatus of claim 1 wherein the pins are generally parallel.

8. The shackle apparatus of claim 1 wherein the pins and drive shaft each have central longitudinal axes that are generally parallel.

9. The shackle apparatus of claim 1 wherein the pinion gear and locking members each have peripherally positioned teeth.

10. The shackle apparatus of claim 9 wherein the teeth on the locking members extend only partially around the periphery of the locking member.

11. The shackle apparatus of claim 1 wherein the drive shaft has a tool receptive socket that enables a user to rotate the drive shaft using a tool that fits the drive shaft socket.

12. A shackle apparatus comprising:

a) a generally U shaped bow having bow end portions, each bow end portion having a recess;

b) a pin assembly that detachably connects to the bow, the pin assembly having upper and lower end portions and including a frame having external surface areas, spaced apart plates with a pair of locking members sandwiched therebetween, each locking member being pivotally attached to the frame, each locking member having a projecting portion that engages the recess of a bow end portion;

c) a pinion gear having a periphery that engages the locking members, the pinion gear being rotatably mounted to the frame in between the plates and generally in between the locking members;

d) a keyed drive shaft for rotating the pinion gear with a key that removably fits the drive shaft on an external surface area of the pin assembly next to the upper end portion; and e) pins that hold the plates apart and wherein a locking member is mounted to each pin.

13. The shackle apparatus of claim 12 wherein the bow end portions have narrowed sections next to a recess.

14. The shackle apparatus of claim 12 wherein the bow recesses face inwardly, toward each other.

15. The shackle apparatus of claim 12 wherein the bow end portions are generally rectangular in transverse cross section.

16. The shackle apparatus of claim 12 wherein the bow end portions each register in openings in the plates.

17. The shackle apparatus of claim 16 wherein the openings are generally rectangular in shape.

18. The shackle apparatus of claim 12 wherein the pins are generally parallel.

19. The shackle apparatus of claim 12 wherein the pins and drive shaft each have central longitudinal axes that are generally parallel.

20. The shackle apparatus of claim 12 wherein the pinion gear and locking members each have peripherally positioned teeth.

21. The shackle apparatus of claim 20 wherein the teeth on the locking members extend only partially around the periphery of the locking member.

22. The shackle apparatus of claim 12 wherein the drive shaft has a tool receptive socket that enables a user to rotate the drive shaft using a tool that fits the drive shaft socket.

* * * * *